US007004576B2

(12) United States Patent
Ito

(10) Patent No.: US 7,004,576 B2
(45) Date of Patent: Feb. 28, 2006

(54) INK-JET PRINTHEAD

(75) Inventor: Atsushi Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 180 days.

(21) Appl. No.: 10/650,744

(22) Filed: Aug. 29, 2003

(65) Prior Publication Data

US 2004/0056937 A1 Mar. 25, 2004

(30) Foreign Application Priority Data

Sep. 19, 2002 (JP) ..... 2002-273478

(51) Int. Cl.
*B41J 2/175* (2006.01)

(52) U.S. Cl. ..... 347/93; 347/70; 347/71; 347/72

(58) Field of Classification Search ..... 347/68–72, 347/65, 93, 94
See application file for complete search history.

(56) References Cited

U.S. PATENT DOCUMENTS 5,489,930 A 2/1996 Anderson
6,575,565 B1 6/2003 Isono et al.
2002/0180827 A1 * 12/2002 Hirota ..... 347/20

FOREIGN PATENT DOCUMENTS

| | | |
|---|---|---|
| JP | A 9-314836 | 12/1997 |
| JP | A 2001-162796 | 6/2001 |
| JP | A 2002-355962 | 12/2002 |

* cited by examiner

*Primary Examiner*—Stephen Meier
*Assistant Examiner*—Ly T. Tran
(74) *Attorney, Agent, or Firm*—Oliff & Berridge, PLC

(57) ABSTRACT

An ink-jet printhead includes a cavity unit and an actuator stacked together. The cavity unit is provided with a row of nozzle orifices and a row of pressure chambers communicating with the respective nozzle orifices. The actuator has a plurality of active portions for selectively actuating the respective pressure chambers to eject ink through the respective orifices. The cavity unit is a stack of plates including a cavity plate formed with the pressure chambers, a manifold plate formed with a manifold chamber and an intervenient plate interposed between the cavity plate and the manifold plate. The manifold chamber supplies ink from an external ink supply source to each of the pressure chambers. The intervenient plate is formed with a filter portion which filters ink provided from the external ink supplying source to the manifold chamber. The intervenient plate is formed with a damper wall facing the manifold chamber. The damper wall has a partial thickness of the intervenient plate.

20 Claims, 4 Drawing Sheets

INK-JET PRINTHEAD

BACKGROUND OF THE INVENTION

The present invention relates to an ink-jet printhead, and more particularly to an ink-jet printhead provided with a filter for removing foreign matter from ink.

Japanese Patent Application Provisional Publication HEI 9-314836 discloses an ink-jet printhead having a laminated structure and actuated by a piezoelectric actuator on demand. The disclosed ink-jet printhead is constructed from substantially six plates stacked together in a laminated body. Assuming that the uppermost plate is the first plate and the lowermost one the sixth plate, the second plate sandwiched between the first and third plates is formed with a plurality of small openings that function as pressure generating chambers. The fifth plate sandwiched between the fourth and sixth plates is provided with a plurality of large openings that define common ink supply chambers.

The common ink supply chambers are filled with ink supplied from an external ink tank, which ink is then distributed to the plurality of pressure generating chambers through ink channels formed in the third and fourth plates.

Each pressure generating chamber is in fluid communication with a corresponding one of a plurality of nozzle orifices formed in the sixth plate or the lowermost plate. Further, a piezoelectric vibration plate is fixed on the top surface of the first plate so as to selectively compress each pressure generating chamber. When one of the pressure generating chambers is compressed, an ink droplet ejects from the nozzle orifice corresponding to the compressed pressure generating chamber.

The fourth plate is provided with recesses that are formed at areas facing the common ink supply chambers. These recesses isolate vibration generated by the piezoelectric vibration plate.

An ink supply channel is formed in the laminated body of the ink-jet printhead through which ink from the external ink tank flows into the common ink supply chambers. Generally, a separate plate-like filter is attached to the inlet of the ink supply channel for removing foreign matter from the ink flowing into the common ink supply chambers, since such foreign matter might clog up the nozzle orifices of the printhead. The filter is an essential component of the ink-jet printhead. However, it increases the component count of the ink-jet printhead, and also requires additional work for attaching it to the ink-jet printhead.

Therefore, there is a need for an ink-jet printhead that does not require attaching a filter thereto for filtering ink supplied from an external ink tank.

SUMMARY OF THE INVENTION

The present invention is advantageous in that an ink-jet printhead is provided that satisfies the above mentioned need.

An ink-jet printhead according to an aspect of the invention includes a cavity unit and an actuator stacked together. The cavity unit is provided with a row of nozzle orifices and a row of pressure chambers communicating with the respective nozzle orifices. The actuator has a plurality of active portions for selectively actuating the respective pressure chambers to eject ink through the respective orifices. The cavity unit is a stack of plates including a cavity plate formed with the pressure chambers, a manifold plate formed with a manifold chamber and an intervenient plate interposed between the cavity plate and the manifold plate. The manifold chamber supplies ink from an external ink supply source to each of the pressure chambers. The intervenient plate is formed with a filter portion which filters ink provided from the external ink supply source to the manifold chamber. The intervenient plate is formed with a damper wall facing the manifold chamber. The damper wall has a partial thickness of the intervenient plate.

In the ink-jet printhead arranged as above, it is not necessary to additionally attach a separate ink filter to the ink-jet printhead since the intervenient plate includes a filter portion. Thus, the ink-jet printhead can be easily assembled.

Optionally, the damper wall defines a recess on a side of said intervenient plate opposite from the manifold plate. Further optionally, the recess may be sealed with a base plate interposed between the cavity plate and the intervenient plate.

Optionally, the intervenient plate may be formed with a plurality of restricting channels which bring the pressure chambers in fluid communication with the manifold chamber. The restricting channels may be tapered from the manifold chamber toward the respective pressure chamber. A base plate may be further interposed between the cavity plate and the intervenient plate, which base plate is formed with a plurality of ink channels that bring the restricting channels in fluid communication with the respective pressure chambers.

Optionally, the filter portion may be formed in a locally thin region of the intervenient plate. Further optionally, the filter portion may include a plurality of small holes penetrating the intervenient plate in the locally thin region.

Optionally, the ink-jet printhead may further comprise a cover plate stacked on a side of the manifold plate opposite from the intervenient plate, so that the manifold chamber can be defined by an opening formed through the manifold plate and sandwiched between the intervenient plate and the cover plate.

When the intervenient plate includes the filter portion, the damper wall, and a plurality of restricting channels, the plurality of restricting channels and the filter portion may be arranged outside the damper wall.

In the above case, both of the manifold chamber and the damper wall may be formed in elongated shapes so that the manifold chamber extends, at its lengthwise end, beyond the damper wall, and the filter portion is formed at a position corresponding to the lengthwise end of the manifold chamber.

Alternatively, both of the manifold chamber and the damper wall may be formed in elongated shapes and the restriction channels may be arranged along an outer side edge of the damper wall, in a lengthwise direction of the manifold chamber to fall within an outer region of the manifold chamber, and the damper wall may overlap an inner region of the manifold chamber.

In an ink-jet printhead according to another aspect of the invention is provided with a plurality of nozzle orifices, a plurality of pressure chambers, and a common ink chamber. The plurality of nozzle orifices are formed on one surface of the ink-jet print head. The plurality of pressure chambers are in fluid communication with respective ones of the nozzle orifices. Each pressure chamber is filled with ink and selectively pressurized to eject the ink from a corresponding one of the nozzle orifices. The common ink chamber is filled with ink to be supplied to the pressure chambers. The ink channel extends from the common ink chamber to supply therethrough ink from an external ink supply source.

The ink-jet print head is further provided with a substrate placed between the plurality of pressure chambers and the common ink chamber so as to damp pressure wave propagating from the pressure chambers toward the common ink chamber. An ink filter is integrally formed in the substrate and disposed in the ink channel to remove foreign matter from the ink flowing into the common ink chamber.

The ink filter may include a plurality of through holes formed in the substrate in a cluster. Further, the substrate may have a recess on one side thereof, and the plurality of through holes may be formed in a portion of the substrate defining the recess. In some cases, the recess is formed on a side of the substrate from which the ink from the external ink supply source enters the ink filter.

The plurality of through holes may be formed by laser ablation. In this case, the substrate may be made of synthetic resin. The recess may be formed by plasma etching.

Optionally, the substrate may have a low stiffness region which has a lower mechanical stiffness than a remaining portion of the substrate. The low stiffness region may extend over the plurality of pressure chambers. Such low stiffness region can be formed as a recess on one side of the substrate, for example.

BRIEF DESCRIPTION OF THE ACCOMPANYING DRAWINGS

DETAILED DESCRIPTION OF THE EMBODIMENTS

Hereinafter, an piezoelectric type ink-jet printhead 100 according to an embodiment of the invention will be described with reference to the accompanied drawings.

Figure 1:
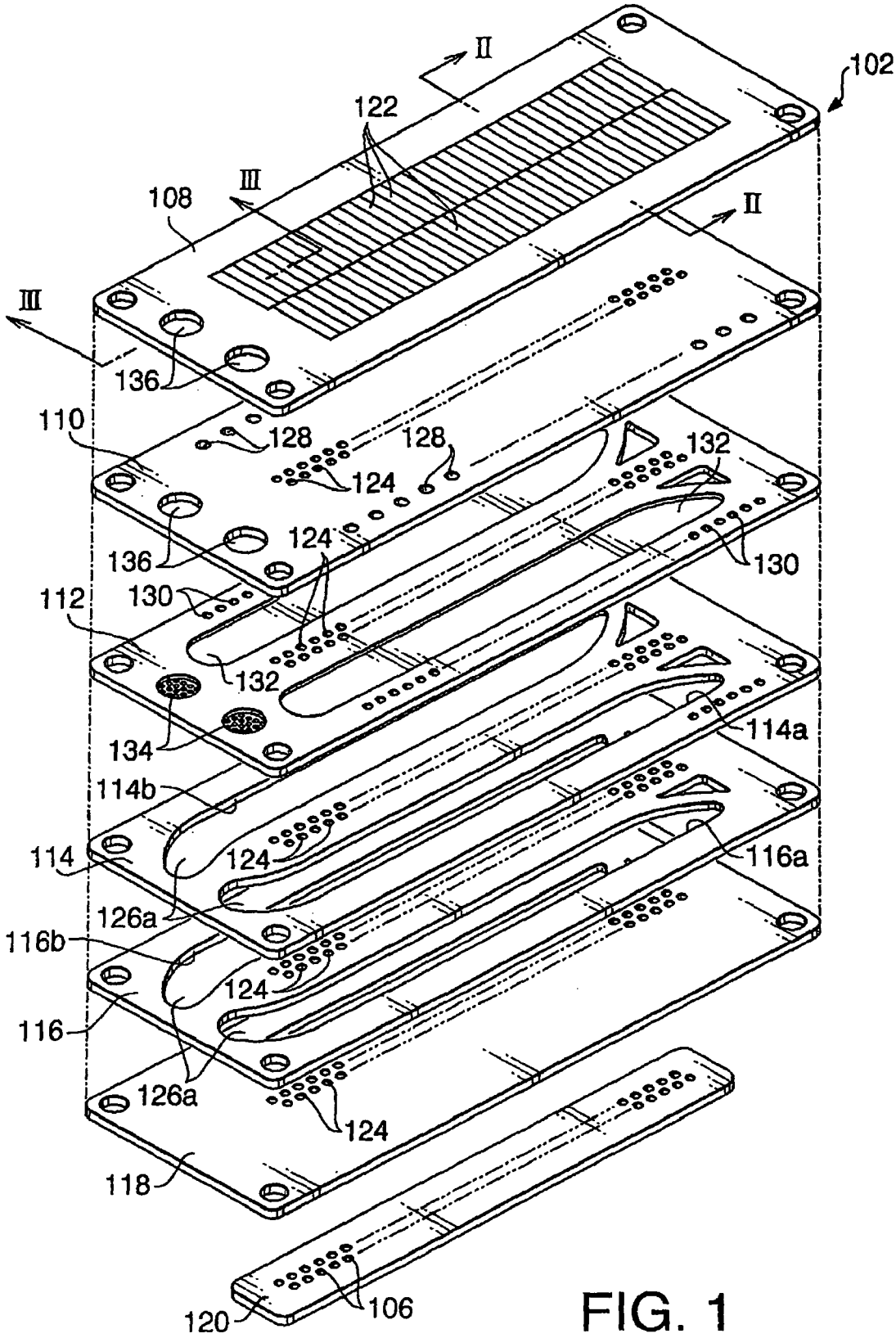
FIG. 1 is an exploded perspective view of a cavity unit of an ink-jet printhead according to an embodiment of the invention.
Figure 2:
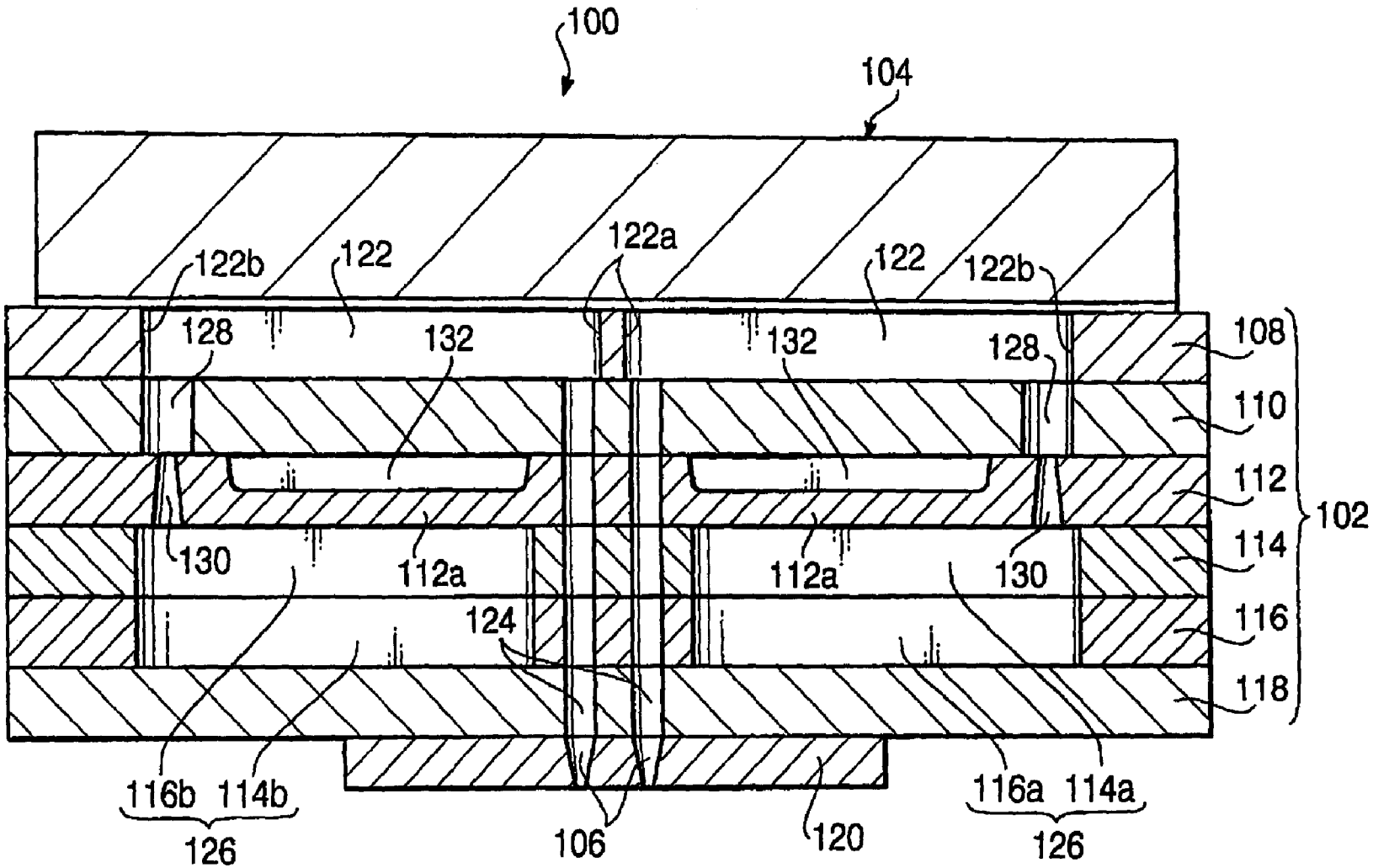
FIGS. 2 and 3 are enlarged cross-sectional views of the ink-jet printhead according to the embodiment of the invention taken along lines II—II and III—III of FIG. 1, respectively.
Figure 3:
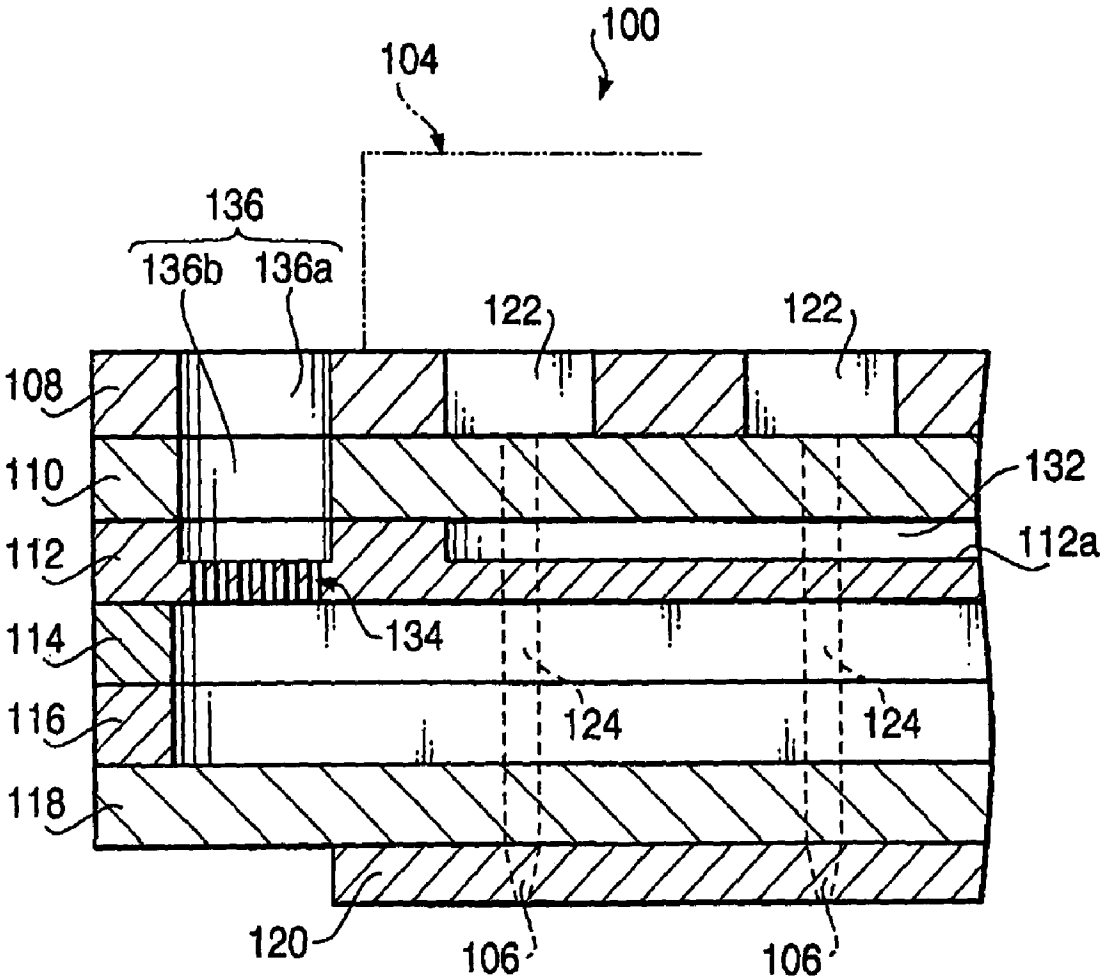

FIG. 1 is an exploded perspective view of a cavity unit 102 of the ink-jet printhead 100. FIGS. 2 and 3 are enlarged cross-sectional views of the ink-jet printhead 100 taken along lines II—II and III—III of FIG. 1, respectively.

As shown in FIGS. 2 and 3, the ink-jet printhead 100 includes a plate type piezoelectric actuator 104 mounted on the top of the cavity unit 102. The piezoelectric actuator 104 is connected with an external controller (not shown) through a flexible flat cable (not shown) connected to the upper surface of the piezoelectric actuator 104. The ink-jet printhead 100 is configured so as to eject ink downwards therefrom through a plurality of nozzle orifices 106 open toward the bottom of the cavity unit 102.

As shown in FIG. 1, the cavity unit 102 is formed from a plurality of thin plates, i.e., a cavity plate 108, a base plate 110, an intervenient plate 112, two manifold plates 114 and 116, a cover plate 118, and a nozzle plate 120, which are adhered to each other in a laminated stack in this order from the top. In the present embodiment, the intervenient plate 112 and the nozzle plate 120 are made of synthetic resin, such as polyimide resin, while the other plates (108, 110, 114, 116, 118) are made of 42% nickel steel to a thickness of about 50 $\mu$m to about 150 $\mu$m. It should be noted, however, the intervenient plate 112 and the nozzle plate 120 may also be made of metal.

As will be described hereinafter, the above-mentioned plates of the cavity unit 102 are provided with openings and recesses which are formed by means of electrolytic etching, plasma etching, excimer laser ablation, or the like.

The nozzle plate 120 is provided with two rows of staggered nozzle orifices 106 extending in the lengthwise direction of the nozzle plate 120. In each row, the nozzle orifices 106 are located at regular intervals. Each nozzle orifice is formed in small diameter, which is about 25 $\mu$m in the present embodiment.

The cavity plate 108 is provided with two rows of staggered pressure chambers 122. As shown in FIG. 2, each of the pressure chambers 122 is positioned in association with the corresponding nozzle orifice 106. Each pressure chamber 122 is oriented with one end in the lengthwise direction thereof nearer to the center of the cavity plate 108 and the other end nearer to the outside of the cavity plate 108. Note that the former end will be referred to hereinafter as a center side end 122*a* and the later as an outside end 122*b*. The center side end 122*a* of each pressure chamber 122 is in fluid communication with the corresponding nozzle orifice 106 through an ink channel 124 that is formed by through holes provided in the base plate 110, the intervenient plate 112, the two manifold plates 114 and 116, and the cover plate 118. The outside end 122*b* of each pressure chamber 122 is in fluid communication with corresponding one of a pair of manifold chambers 126 through a through hole 128, or an ink channel, formed in the base plate 110 and a restricting channel 130 formed in the intervenient plate 112. Each restricting channels 130 are formed such that the cross section thereof gradually decreases toward the base plate 110.

The pair of manifold chambers 126, which function as common ink chambers, are defined by openings (114*a*, 114*b*, 116*a* and 116*b*) formed in the two manifold plates 114 and 116. The pair of manifold chambers 126 is located on both sides of the rows of the nozzle orifices 106 (or the rows of ink channels 124). As shown in FIG. 1, each of the pair of manifold chambers 126 has an elongated form that extends in the direction of the row of the nozzle orifices 106 or the row of the pressure chambers 122. Each of the manifold chambers 126 is placed below the corresponding row of the pressure chambers 122. One end 126*a* of each of the manifold chambers 126 extends in the lengthwise direction from the corresponding row of the pressure chambers 122.

As shown in FIG. 2, the upper surface of each manifold chamber 126 is defined by the undersurface of the intervenient plate 112 adhered to top of the upper manifold plate 114. The bottom of each manifold chambers 126 is defined by the top surface of cover plate 118 adhered to the undersurface of the lower manifold plate 114.

Referring to FIGS. 1 and 2, a pair of elongated recesses (damper chambers) 132 are formed in the intervenient plate 112 on the side facing the base plate 110. The bottom of each recess 132 is a thin wall which will be referred to hereinafter as damper wall 112*a*. The recesses 132 have substantially the same length as the rows of the pressure chambers 122 and extend below the rows of the pressure chambers 122. In other words, the recesses 132 are located between the rows of the pressure chambers 122 and the manifold chambers 126 so that the damper walls 112*a* form part of the upper walls of respective manifold chambers 126. Note that the recesses 132 do not extend up to the ends 126*a* of the manifold chambers 126.

Each recess 132 has a shorter width (dimension in the direction perpendicular to the lengthwise direction thereof) than the corresponding manifold chamber 126. Each recess 132 is located such that the side edges of the recess 132 and the manifold chamber 126 nearer to the ink channels 124 are aligned with each other. As shown in FIG. 2, the side edge of each recess 132 that is opposite from the ink channels 124 is displaced from the corresponding side edge of the corresponding manifold chamber 126, providing a space for forming the row of restricting channels 130 in the intervenient plate 112 along the lengthwise direction of the recess 132. Thus, the restricting channels 130 are in fluid communication with the manifold chamber 126 in the vicinity of the side thereof opposite from the ink channels 124.

Referring to FIG. 1, the intervenient plate 112 is provided with a plurality of staggered through holes, which are part of the ink channels 124, at substantially the middle of the intervenient plate 112 in the width direction, or at a region between the pair of the recesses 132. Further, the intervenient plate 112 is formed with a pair of filter portions 134 located near one end thereof in the lengthwise direction.

Figure 4:
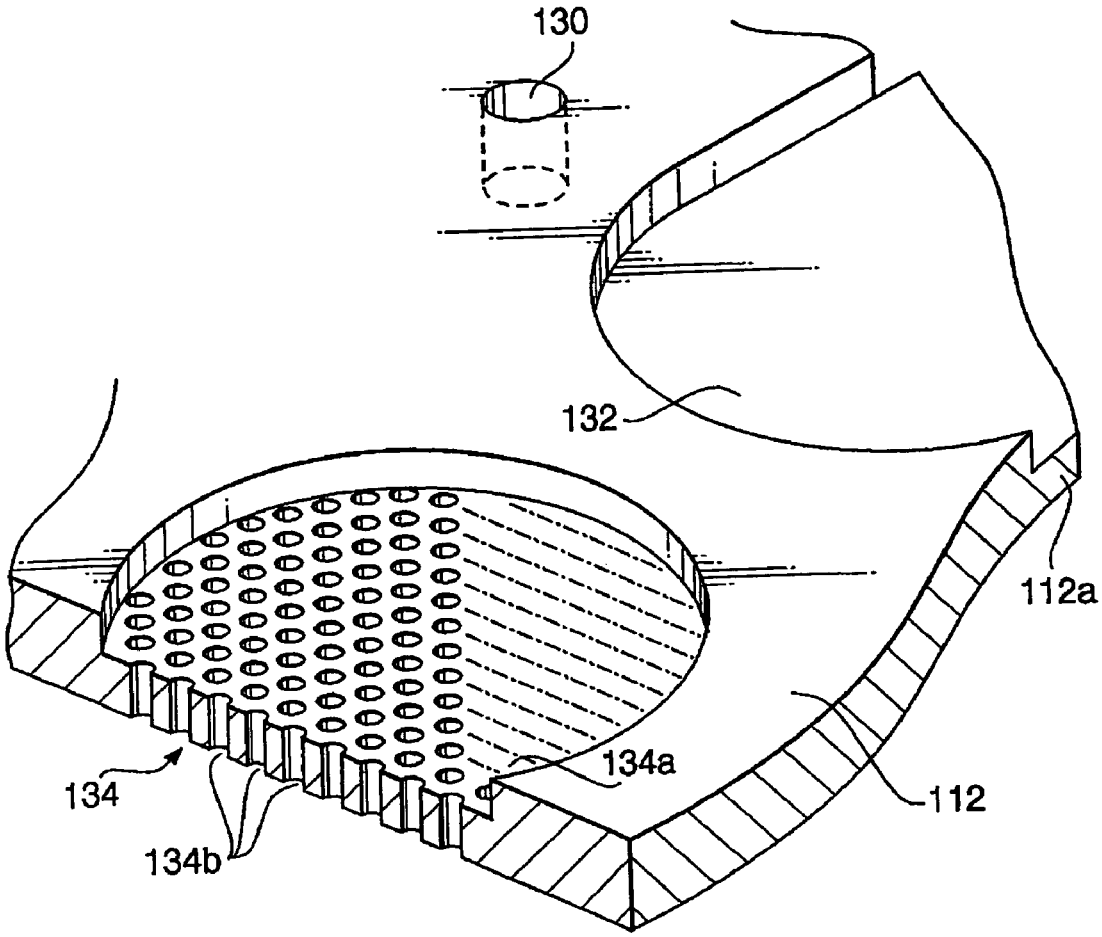
FIG. 4 is an enlarged perspective view of a part of an intervenient plate of the ink-jet print head shown in FIGS. 2 and 3.

FIG. 4 is an enlarged perspective view of a part of the intervenient plate 112. As shown in FIG. 4, each of the pair of filter portions 134 includes a recessed thin-walled portion 134*a* provided with a plurality of small filter holes 134*b* penetrating the thin-wall portion 134*a*.

In the present embodiment, the recess 132 and the thin-wall portion 134*a* of the intervenient plate 112 are formed by means of plasma etching, while the restricting channel 130 and the filter holes 134*b* of the filter portion 134 are formed by laser ablation using excimer laser. Plasma etching and laser ablation allow simultaneous forming of the recess 132 and the thin-walled portion 134*a*, and simultaneous forming of the through holes for the ink channels 124, the restricting channels 130 and the filter holes 134*b*, which in turn allows forming the small restricting channels 130 and the small filter holes 134*b* at accurate positions and in precise forms. Note that the restricting channels 130 should be formed precisely since they are required to supply a sufficient amount of ink to the pressure chambers 122 from the manifold chambers 126 while preventing ink from flowing back into the manifold chambers 126 due to the pressure wave generated within the pressure chambers 122. Further, the accurately positioned holes and recesses (the through holes for the ink channels 124, the recesses 132, the restricting channels 130 and the filter holes 134*b*) in the intervenient plate 112 facilitate the alignment of the intervenient plate 112 with the base plate 110 and the manifold plates 114 and 116.

Referring now to FIGS. 1 and 3, the filter portions 134 are formed so as to be located above the ends 126*a* of the manifold chambers 126. The cavity plate 108 and the base plate 110 placed above the intervenient plate 112 are formed with a pair of through holes 136*a* and a pair of through holes 136*b*, respectively, at positions corresponding to the filter portions 134. The through holes 136*a* and 136*b* form two ink supply channels 136 extending upwardly from respective filter portions 134.

Ink from an external ink supply source (not shown) is provided into both of the ink supply channels 136 from the top thereof. The ink passes through each filter portion 134 by which foreign matter, such as dust, is removed therefrom. Then, the ink flows into the pair of manifold chambers 126 and is distributed to the pressure chambers 122 through the restriction channels 130 and the through holes 128 (see FIG. 2). Further, the ink flows from the pressure chambers 122 into the corresponding ink channels 124 and finally reaches the corresponding nozzle orifices 106.

The piezoelectric actuator 104 has substantially the same configuration as that disclosed in Japanese Patent Application Provisional Publication No. P2001-162796, the disclosure of which is hereby incorporated by reference. The piezoelectric actuator 104 includes a stack of a plurality of piezoelectric sheets (not shown). Each piezoelectric sheet has a thickness of about 30 $\mu$m. A plurality of narrow separate electrodes (not shown) is printed on the upper surface of every two piezoelectric sheets at positions corresponding to the pressure chambers 122. Further, a common electrode is printed on the upper surface of each of the remaining piezoelectric sheets, which common electrode is shared among the above-mention plurality of separate electrodes. The common electrodes and the separate electrodes are electrically connected with a plurality of connection terminals (not shown) formed on the top surface of the uppermost piezoelectric sheet through conductive lines (not shown) formed to extend vertically on a side wall of the piezoelectric actuator 104. The plurality of connection terminals are further connected with the conductive lines of the previously mentioned flexible flat cable.

If voltage is applied between the common electrode and selected one of the separate electrodes, the portion of the piezoelectric actuator 104 therebetween, which will be referred to hereinafter as active portion, deforms in the direction the piezoelectric sheets are stacked. By selectively deforming the active portion, the volume of the corresponding pressure chamber 122 can be reduced which causes an ink droplet to be ejected from the corresponding nozzle orifice 106.

The deformation of the piezoelectric actuator generates a pressure wave in the pressure chamber 122. The pressure wave includes not only a forward component that propagates toward the corresponding nozzle orifice 106 but also a backward component that propagates toward the manifold chambers 126 or the common ink chambers.

As may be understood from FIG. 2, the backward component of the pressure wave propagates through the through hole 128, the restriction channel 130, and the manifold chamber 126. Since the damper wall 112*a* is a thin wall, it has a lower mechanical stiffness than the remaining portion of the intervenient plate 112 and can resiliently deform. Thus the damper wall 112*a* vibrates in accordance with the pressure wave and thereby effectively absorbs the pressure wave. Further, the air sealed in the recess (damper chamber) 132 of the intervenient plate 112 by the base plate 110 also damps the pressure wave propagating therethrough. Thus, the pressure wave that affects the other pressure chambers 122 becomes quite week, and does not cause the so called cross-talk between the pressure chambers 122.

The vibration of the damper wall 112*a* causes a change in the volume of the recess (damper chamber) 132. This change, however, does not affect the volume of the pressure chambers 126 nor cause deformation of cavity plate 108 since the base plate 110 having a constant thickness and appropriate stiffness is interposed between the intervenient plate 112 and the cavity plate 108, or between the recesses (damper chambers) 132 and the pressure chambers 122. Accordingly, the vibration of the damper walls 112*a* of the intervenient plate 112 does not affect the ink ejection property of the ink-jet printhead which may deteriorate the printing quality.

As shown in FIG. 1, the plurality of the restricting channels 130 and the pair of filter portions 134 of the intervenient plate 112 are arranged outside each recess 132 and along the periphery of each recesses (damper chamber) 132. More specifically, each row of the restricting channels 130 are formed adjacent to the side edge of the corresponding recess 132 on the side opposite from the rows of the ink channels 124 so as to extend along that side edge, or in the lengthwise direction of the corresponding recess 132. Further, each filter portion 134 is located adjacent to one end of the corresponding recess 132 in the lengthwise direction thereof. This reasonable arrangement allows the pair of recesses 132, the pair of filter portions 134, and the rows of restricting channels 130 to be formed in a small area of the intervenient plate 112 while keeping dimensions of the recess (damper chamber) 132 or the damper wall 112*a* sufficiently large to obtain a high damping effect.

It may be appreciated from the description herein above that since the recesses (damper chamber) 132, the restricting channels 130, the filter portions 134, and the ink channels 124 are all formed in one intervenient plate 112, the above-mentioned holes or recesses can be formed in precise shapes and at accurate relative positions. The precisely shaped and accurately positioned holes and recesses in the intervenient plate 112 facilitate the alignment of the intervenient plate with other plates, such as the base plate 110 and the manifold plates 114 and 118, at the time of assembling the cavity unit 102, and also reduce the alignment error between the plates.

Further, since the filter holes 134*b* are formed in the thin-walled portion 134*a* of the filter portion 134, the effective area of the filter portion 134 does not decrease even if the base plate 110 is stacked onto the intervenient plate 112 without being accurately aligned with the intervenient plate 112. In addition, since the thin-walled portion 134*a* is relatively thin, the plurality of filter holes 134*b* can be formed in a short time and hence the manufacturing efficiency of the ink-jet print head can be enhanced. Further, unlike the case where a separate filter is disposed on the intervenient plate 112 to underlie the through hole 136, no undesirable clearance is created between the intervenient plate 112 and the base plate 110 because the filter portion 124 is formed integrally in the intervenient plate 112.

The manifold chambers 126 are designed to have a same thickness as the overall thickness of the two manifold plates 114 and 116. Thus, the manifold chambers 126 with an accurate depth can be made by simply forming openings in the two manifold plates 114 and 116 and piling up them on the cover plate 118 which forms the bottom of the manifold chambers 126.

In the intervenient plate 112, the plurality of the restricting channels 130 and the pair of filter portions 134 are arranged around the recesses (damper chamber) 132. This reasonable arrangement allows the pair of recesses 132, the pair of filter portions 134, and the rows of nozzle like channels 130 to be formed in a small area of the intervenient plate 112 while keeping the recess (damper chamber) 132 or the damper wall 112*a* sufficiently large to obtain a high damping effect thereby.

While the invention has been described in detail with reference to specific embodiments thereof, it would be apparent to those skilled in the art that various changes and modifications may be made therein without departing from the spirit of the invention, the scope of which is defined by the attached claims.

For example, the two manifold plates 114 and 116 may be replaced with a thick single manifold plate, or with a stack of three or four thin manifold plates.

Further, the single piezoelectric actuator 104 may be replaced with a plurality of small separate piezoelectric actuators fixed on the cavity unit 102 at positions corresponding to respective pressure chambers 122. Further more, the actuator 104 for providing pressure to the pressure chambers 122 are not limited to piezoelectric type actuators but any other suitable type of actuators may be utilized.

The present disclosure relates to the subject matter contained in Japanese Patent Application No. P2002-273478, filed on Sep. 19, 2002, which is expressly incorporated herein by reference in its entirety.

What is claimed is:

1. An ink-jet printhead, comprising:

a cavity unit and an actuator stacked together, said cavity unit being provided with a row of nozzle orifices and a row of pressure chambers communicating with the respective nozzle orifices, said actuator having a plurality of active portions for selectively actuating the respective pressure chambers to eject ink through the respective nozzle orifices, wherein said cavity unit is a stack of plates including:

a cavity plate formed with said pressure chambers;

a manifold plate formed with a manifold chamber that supplies the ink from an external ink supply source to each of said pressure chambers; and an intervenient plate interposed between said cavity plate and said manifold plate, said intervenient plate being formed with a filter portion that filters the ink supplied from the external ink supply source to said manifold chamber, said intervenient plate being formed with a damper wall facing said manifold chamber, said damper wall having a partial thickness of said intervenient plate.

2. The ink-jet printhead according to claim 1, wherein said damper wall defines a recess on a side of said intervenient plate opposite from said manifold plate.

3. The ink-jet printhead according to claim 2, wherein said cavity unit further includes a base plate interposed between said cavity plate and said intervenient plate, said base plate sealing said recess in said intervenient plate.

4. The ink-jet printhead according to claim 1, wherein said intervenient plate is formed with a plurality of restricting channels, said restricting channels bringing the respective pressure chambers in fluid communication with said manifold chamber.

5. The ink-jet printhead according to claim 4, wherein said restricting channels are tapered from said manifold chamber toward the respective pressure chambers.

6. The ink-jet printhead according to claim 4, wherein said cavity unit further includes a base plate interposed between said cavity plate and said intervenient plate, said base plate being formed with a plurality of ink channels, said ink channels bringing said restriction channels in fluid communication with the respective pressure chambers.

7. The ink-jet printhead according to claim 1, wherein said filter portion is formed in a locally thin region of said intervenient plate.

8. The ink-jet printhead according to claim 7, wherein said filter portion includes a plurality of small holes penetrating said intervenient plate in said locally thin region.

9. The ink-jet printhead according to claim 1, further comprising a cover plate stacked on a side of said manifold plate opposite from said intervenient plate, wherein said manifold chamber is defined by an opening formed through said manifold plate and sandwiched between said intervenient plate and said cover plate.

10. The ink-jet printhead according to claim 1, wherein said intervenient plate is formed with:

a damper wall extending over a region corresponding to said manifold chamber; and a plurality of restricting channels that connect the respective pressure chambers in fluid communication with said manifold chamber, wherein said plurality of restricting channels and said filter portion are arranged outside said damper wall.

11. The ink-jet printhead according to claim 10, wherein both of said manifold chamber and said damper wall are formed in elongated shapes, and said manifold chamber extends, at its lengthwise end, beyond said damper wall, and said filter portion is formed at a position corresponding to said lengthwise end of said manifold chamber.

12. The ink-jet printhead according to claim 10, wherein both of said manifold chamber and said damper wall are formed in elongated shapes, and said restriction channels are arranged along an outer side edge of said damper wall, in a lengthwise direction of said manifold chamber to fall within an outer region of said manifold chamber, and said damper wall overlaps an inner region of said manifold chamber.

13. An ink-jet printhead, comprising:

a plurality of nozzle orifices formed on one surface of said ink-jet printhead;

a plurality of pressure chambers being in fluid communication with respective ones of said nozzle orifices, each pressure chamber being filled with ink and selectively pressurized to eject the ink from a corresponding one of said nozzle orifices;

a common ink chamber filled with ink to be supplied to said pressure chambers;

an ink channel extending from said common ink chamber to supply therethrough ink from an external ink supply source to said common ink chamber;

a substrate placed between said plurality of pressure chambers and said common ink chamber, the substrate being formed with a recess on one side thereof to provide a low stiffness region that damps a pressure wave propagating from said pressure chambers toward said common ink chamber; and an ink filter integrally formed in said substrate and disposed in said ink channel to remove foreign matter from the ink flowing into said common ink chamber.

14. The ink-jet printhead according to claim 13, wherein said ink filter includes a plurality of through holes formed in said substrate in a cluster.

15. The ink-jet printhead according to claim 14, wherein said substrate has a recess on one side thereof, and wherein said plurality of through holes are formed in a portion of said substrate defining said recess.

16. The ink-jet printhead according to claim 15, wherein said recess is formed on a side of said substrate from which the ink from the external ink supply source enters said ink filter.

17. The ink-jet printhead according to claim 15, wherein said recess includes recessed portions formed by plasma etching.

18. The ink-jet printhead according to claim 14, wherein said plurality of through holes include holes formed by laser ablation.

19. The ink-jet printhead according to claim 18, wherein said substrate is made of synthetic resin.

20. The ink-jet printhead according to claim 13, wherein said low stiffness region of said substrate has a lower mechanical stiffness than a remaining portion of said substrate, and said low stiffness region extends over said plurality of pressure chambers.

* * * * *